US007578779B2

(12) United States Patent
Selle

(10) Patent No.: US 7,578,779 B2
(45) Date of Patent: Aug. 25, 2009

(54) BAG MACHINE AND WINDER

(75) Inventor: Paul A. Selle, Appleton, WI (US)

(73) Assignee: CMD Corporation, Appleton, WI (US)

( * ) Notice: Subject to any disclaimer, the term of this patent is extended or adjusted under 35 U.S.C. 154(b) by 221 days.

(21) Appl. No.: 11/531,906

(22) Filed: Sep. 14, 2006

(65) Prior Publication Data

US 2008/0067279 A1 Mar. 20, 2008

(51) Int. Cl.
*B31B 1/64* (2006.01)

(52) U.S. Cl. ..... 493/193; 493/196; 493/197; 493/198; 493/202; 493/205; 493/208; 242/528

(58) Field of Classification Search ..... 493/193, 493/197, 198, 196, 202, 205, 208; 242/528, 242/531, 541.3
See application file for complete search history.

(56) References Cited

U.S. PATENT DOCUMENTS

| | | | | |
|---|---|---|---|---|
| 171,286 | A | 12/1875 | Jay | |
| 2,773,418 | A | 12/1956 | Perzentka et al. | |
| 3,030,750 | A | 4/1962 | Lowe | |
| 3,783,750 | A * | 1/1974 | Heimeijer | 493/196 |
| 4,642,084 | A | 2/1987 | Geitman, Jr. | |
| 4,667,890 | A | 5/1987 | Geitman, Jr. | |
| 4,695,005 | A | 9/1987 | Geitman, Jr. | |
| 4,934,993 | A | 6/1990 | Geitman, Jr. | |
| 4,991,376 | A * | 2/1991 | Backman | 53/399 |
| 5,318,237 | A | 6/1994 | Lotto et al. | |
| 5,377,929 | A | 1/1995 | Geitman, Jr. et al. | |
| 5,518,559 | A | 5/1996 | Saindon et al. | |
| 5,587,032 | A | 12/1996 | Saindon et al. | |
| 5,899,403 | A * | 5/1999 | Gietman et al. | 242/528 |
| 6,117,058 | A | 9/2000 | Sauder et al. | |
| 6,186,436 | B1 * | 2/2001 | Selle et al. | 242/532.2 |
| 6,364,241 | B1 | 4/2002 | Bartels | |
| 6,746,389 | B2 | 6/2004 | Selle et al. | |
| 6,761,329 | B2 * | 7/2004 | Bartels et al. | 242/528 |

(Continued)

OTHER PUBLICATIONS

PCT Notification of Transmittal of the International Search Report and Written opinion of the International Search Authoity, or the Declaration.

*Primary Examiner*—Sang Kim
(74) *Attorney, Agent, or Firm*—George R. Corrigan

(57) ABSTRACT

A method and apparatus for making and winding bags is disclosed. The bag machine includes an unwind section, a forming section, and a winder. The winder has an infeed nip and two spindles. Each spindle is located along a respective one of two alternative film paths. The spindles can be fixed position spindles and the alternative film paths can be predominantly downward. An over speed nip may be provided between the infeed nip and the alternative film paths to separate rolls or to separate all bags. An overlapper can be included. Rods that travel in an elliptical orbit, and/or air nozzles can be part of the overlapper. Air nozzles can also be used to direct the film to the appropriate alternative path. Conveyor belts along the alternative film paths can be used to guide the film. Static pinners can be used to help bold the bags to the conveyor, or the last bag to the roll. Pop-up fingers and air horns can help start the roll on a spindle. Paper banders can be use, as can pneumatic devices. A push off device that scrape the spindles over substantially 360 degrees can be used.

6 Claims, 2 Drawing Sheets

U.S. PATENT DOCUMENTS 7,108,219 B2 9/2006 Fiedler
2006/0084559 A1 4/2006 Selle et al.
2006/0229182 A1* 10/2006 Selle et al. ..... 493/450
2008/0067279 A1 3/2008 Selle

* cited by examiner

BAG MACHINE AND WINDER

FIELD OF THE INVENTION

The present invention relates generally to the art of bag making. More specifically, it relates to making and winding bags.

BACKGROUND OF THE INVENTION

There are a variety of known bag machines used for making bags from a continuous film, such as a polyolefin film. Commercially available bag machines, winders, and folders include CMD® Models 3113, 1100 series, 1500, 4013RO series, and other machines described at www.cmd-corp.com. Examples of patented prior art bag machines include U.S. Pat. Nos. 6,117,058, 4,934,993, 5,518,559, 5,587,032 and 4,642,084 and US Patent Publication 20060084559 (each of which is hereby incorporated by reference).

Generally, those machines unwind the film from a roll. The film may be a single film, or folded film, or a (flat) tube. Bags are formed by placing seals on the film in desired locations. The seals may form the bottom/top and/or sides of the bag. Perforations may be included denoting sides or top/bottom of adjacent bags. Other operations may be performed such as separating and/or folding.

The bag machine shown in U.S. Pat. No. 6,117,058 is owned by the owner of this invention, and may be seen in FIG. 1. Prior art rotary bag machine 100 continuously processes a web 201 using a dancer assembly 203, a pair of drum-in rolls 205 and 206 (203-206 are part of an input section), a sealing drum 208, a pair of drum-out rolls 210 and 211, a sealing blanket 213, a pair of knife-in rolls 215 and 216, a knife 218 (which could be any other web processing device such as a perforator, knife, die cutter, punching station, or folding station), a pair of knife-out rolls 219 and 220 (210-220 are part of an output section), and a controller 221. Input section or unwind section, as used herein, includes the portion of a bag machine where the web is received, such as an unwind and a dancer assembly. Output section, as used herein, includes assemblies that act on a web downstream of the seals being formed, such as perforators, winders, folders, etc.

The web is provided through dancer assembly 203 to a forming drum 208. Drum 208 includes a plurality of seal bars 209. The seals bars are heated and create the seals forming the bags from web 201. Web 201 is held against drum 208 (and the seals bars) by a Teflon® coated blanket. End to end bags are formed with one seal from the drum, and side to side bags are formed with a pair of seals. The drum diameter may be adjusted and/or less than all of the seal bars turned on to determine the distance between seals, and hence bag size.

Generally, rotary motion machines register a downstream rotary knife to perforate between two seals, or beside a seal. The prior art of FIG. 1 provides that after web 201 leaves drum 208 it is directed to rotary knife 218, which creates a perforation between bags, or could separate adjoining bags. When the bags are end to end bags, the perforation is placed close to the single seal such that when the bags are separated, the perforation and the perforated end is the top of one bag, and the seal is the bottom of the adjoining bag.

Controller 221 is connected to the various components to control speed, position, etc. Sensors may be used to sense print on the web to form the seals and/or register the perforation (place it in the correct location with respect) to the seal. Also, sensors may detect seals to try and create the perforation in the correct location.

Many bag machines include a winder after the knife. Examples of prior art winders include U.S. Pat. Nos. 4,667,890; 4,695,005; 6186436; and 5,899,403, hereby incorporated by reference. Prior art winders either have a rotating turret with multiple spindles or a single fixed spindle and web stopper. A desired number of bags is wound about the spindle, forming the roll. The roll is then pushed off, often using a push off palm. The roll may be paper banded, and unacceptable rolls may be culled. The prior art describes various ways to properly direct the leading end of the roll to the desired spindle, and to control the winding.

Multiple spindle prior art winders require rotating a turret to move the spindle to the starting and winding position. This adds complexity to the machine, and makes air connections difficult. Also, because the turret rotates, it is used with a push off palm that scrapes the spindle over only part of its circumference. Moreover, moving turrets, push off palms, and air horns can interfere with one another or crash. Stationary winders are limited in the speed because of the time it takes to remove a roll. Prior art winders typically cannot used pneumatic devices in applications over 30 cpm. Rather, such a winder capable of 40 cpm would require servo controlled devices.

Accordingly, a winder with stationary spindles that operates at higher speeds than prior art single spindle systems is desirable. Preferably such a winder can be used with pneumatic devices, and can receive air connections easily.

SUMMARY OF THE PRESENT INVENTION

According to a first aspect of the invention a winder for a bag machine comprises an infeed nip and two spindles. Each spindle is located along one of two alternative film paths.

According to a second aspect of the invention a method of winding bags from a continuous film includes feeding the film into a winder and alternately directing the film along a alternative paths to one of two spindles. The alternations occur after a plurality of bags, such as a roll, are wound.

According to a third aspect of the invention a bag machines includes an unwind section, a forming section, and a winder. The winder includes an infeed nip and two spindles, each located along a respective alternative film path.

The spindles are fixed position spindles in one alternative embodiment.

The alternative film paths are predominantly downward in other embodiments.

An over speed nip may be provided between the infeed nip and the alternative film paths.

The over speed nip operates in an intermittent mode and in an every bag mode, and/or has a user adjustable over speed, in various embodiments The winder includes an overlapper between the infeed nip and the alternative film paths, in other embodiments. The overlapper can include a plurality of rods moved in an orbit that intersects the film path in at least two locations. The orbit can be generally elliptical.

The overlapper includes a plurality of air nozzles in other embodiments.

The over speed nip has air nozzles disposed to direct the film to one alternative film path, and other air nozzles disposed to direct the film to the other alternative film path.

The winder includes conveyor belts along the alternative film paths in other alternatives. The conveyor belts can pivot at an end closest the infeed nip.

The winder includes static pinners along the alternative film paths, that can be bipolar, in various embodiments.

The winder includes pop-up fingers disposed along the alternative film paths in other alternatives.

The winder includes paper banders near the spindles in various embodiments.

The winder is driven with pneumatic air in one embodiment.

The winder includes push off devices that scrape the spindles over substantially 360 degrees in other alternatives.

Other principal features and advantages of the invention will become apparent to those skilled in the art upon review of the following drawings, the detailed description and the appended claims.

Figure 1:
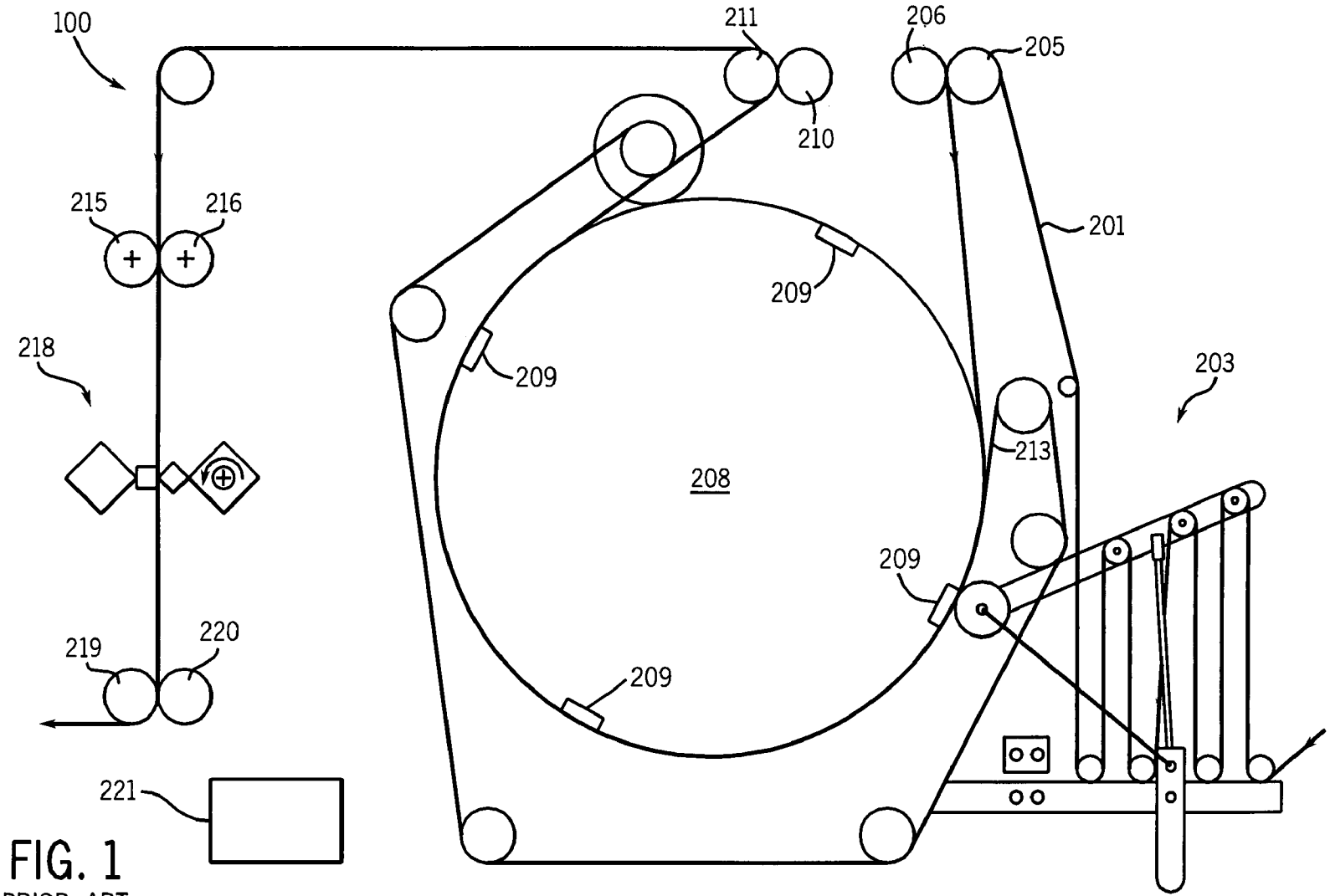
FIG. 1 PRIOR ART
FIG. 1 is diagram of a prior art bag machine.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular bag machine, method and winder, it should be understood at the outset that the invention can also be implemented with other machines, methods, and winders, including draw tape machines, rotary overlap machines, intermittent machines, and other known machines.

Generally, the present invention is described with respect to a winder that can be used with, or is part of, a prior art bag machine to make a roll of bags for easy packaging, transporting, dispensing, and use. The preferred embodiment is described with respect to a bag machine such as that shown in U.S. Pat. No. 6,117,058, or available commercially as the CMD® 1270 bag machine, or a modular bag machine. The invention is contemplated as a winder, a winder and separator, a winder, separator and overlapper, or an entire bag machine. Overlapper, as used herein, includes a device or section that overlaps succeeding bags. The bag machine prior to the winder is described below, since it can be the prior art machine described above. Other bag machines may be used as well.

The winder receives the formed bags as a film, and can separate them using an over speed nip. Over speed nip, as used herein, includes a nip wherein at least one driven roller has a circumferential speed greater than the speed of the film prior to the nip. The nip can operate in an every bag mode, or in an intermittent mode to separate bags only at the start/end of rolls. Every bag mode, as used herein, includes operating for every bag within a roll. Intermittent mode, as used herein, includes not operating for every bag within a roll, such as operating only at the beginning or end of a roll, or for a few bags within a roll. The bags can be overlapped in the every bag mode.

After separating, a film divertor directs the film to one of two spindles. Each winding spindle takes turns winding film, which eliminates bottlenecks and allows for higher speeds, higher cycle speeds, and lower count rolls. The film is directed by the divertor along one of two alternative film paths to one of the two spindles or winding stations. Alternative film path, as used herein, includes a path followed by the film or bags a portion of the time the winder is in use. The alternative paths are preferably predominantly downward, allowing rejected film or missed transfer film to be rejected to the floor in a convenient location. Predominantly downward, as used herein, includes more vertical (with gravity) than horizontal. The spindles are fixed position spindles. Fixed position spindles, as used herein, includes spindles that do not move from a location, such as in an orbit, but can rotate.

When the spindle in use is wound with a complete roll, the leading edge of the first bag of the next roll is directed along the other alternative path to the other spindle. Thus, the winder can wind immediately on the other spindle without moving the spindles, and without having to remove a roll before winding the next roll.

Various embodiments use one or more of the following features, which can be used alone, or in many combinations. Air can be used to direct the film as desired, and pop-up fingers and/or an air horn can be used to start the roll. Static pinning can be used to hold the bags to the spindle, and bipolar static pinning can be used to hold the tail of the last bag of a roll to the roll. Conveyors can be used to guide the film along the alternative paths, and the conveyor can pivot as the roll gets larger, to accommodate its growing diameter. A paper bander can be used and the drying time for the glue can be accommodated since the glue can dry while the other spindle is being used. A push off device can be used to remove rolls, and can scrape substantially 360 degrees around the circumference of the spindle since the spindles are fixed position spindles. Substantially 360 degrees, as used herein, includes over the entire circumference except for occasional small interruptions.

Figure 2:
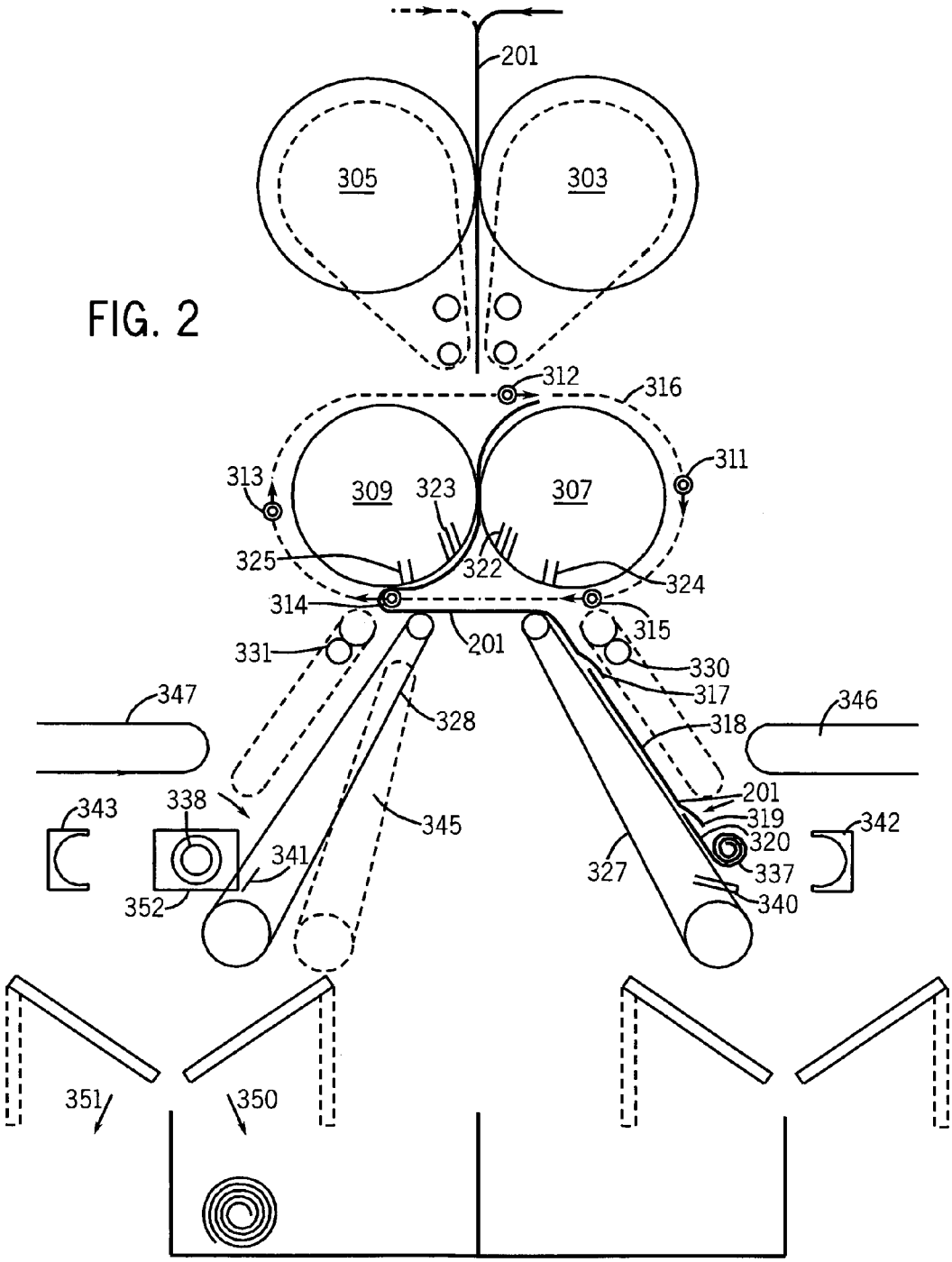
FIG. 2 is diagram of a winder in accordance with the present invention.

Turning now to FIG. 2, a diagram of a winder 200 in accordance with the preferred embodiment is shown. Winder 200 may be downstream along the film path of bag machine 100 of FIG. 1. Many of the alternatives mentioned above are shown, although as stated above, all need not be included.

Film 201 travels from perforator or knife 218 (FIG. 1) to an infeed nip defined between rolls 303 and 305 (FIG. 2), at least one of which is driven. The infeed nip draws or feeds the film into winder 200. (Infeed nip can refer to the infeed for a machine or a section. Here it is used to refer too the infeed of the winder section.)

The preferred embodiment provides for a vertical feed of the web through the infeed nip. This allows the machine to be uni-handed with respect to an operator side, and can accommodate both left and right hand floor plans.

Film 201, after leaving the infeed nip, is provided to an over speed nip defined between rolls 307 and 309, at least one of which is driven. (Film 201 is provided to other stations directly, or indirectly after leaving the infeed nip in various embodiments). Preferably the over speed is servo driven and the over speed percent can be changed easily by the user for a wide perforation repeat distance, such as from 10" to 250" without changing parts.

In an intermittent mode it can run perforation-connected film and separate one of plurality of bags from its succeeding bag by running over speed only after a certain count is complete. In an every bag mode it can be an overlapper and separate and overlap each bag by running over speed all the time. (Every bag made includes not separating a few bags in each roll) The over speed nip can aid in diverting the web to the appropriate alternative path by not running over speed during the last bag of the overlapped roll. Perforation detection is not required (but can be provided) when separating bags.

An overlapper includes rods 311-315 mounted to move in a generally elliptical orbit that intersect the path of film 201 in two places (above and below the nip, preferably). Generally elliptical, as used herein, includes a non circular, non angular path. The orbit is shown clockwise in FIG. 2, where the roll is being wound on a spindle 337, located along one of the alternative film paths. The rotor reverses direction and moves the rods in a counter-clockwise direction when a spindle 338 (located along the other alternative film path) is being used. The rods pull the film laterally, and can aid in separating, although the over speed nip alone can be used to separate if the overlapper is not installed. The rods temporarily accumulate the film to allow for overlapping succeeding bags. Overlapped regions are shown as 317 and 318, and 319 and 320.

The rods are preferably 0.5" diameter steel rods supported on each end with a chain or timing belt, including a driven sprocket and a tensioner sprocket, preferably servo driven. This reduces the distance the web must jump where it is not supported. An air curtain or series of air nozzles may be used to help the film jump the gap created by the mechanical overlap rods. Alternatives includes using air for overlapping, using fewer or more rods, using a different orbit, or other known overlappers.

Over speed rollers 307 and 309 preferably include 0.25" wide grooves on a 1" repeat across the face of both roller faces, to provide clearance for a plurality of air nozzles 322-325 in each groove. Air nozzles 322-325 are used to direct the film to the desired spindle. The upper air nozzles 322 and 323 are used to divert the web to the opposite roller and the lower air nozzles 324 and 325 are used to divert the web down to a nearby conveyor belt 327 or 328, disposed along the film path. As shown in FIG. 3, air nozzles 322 and 325 are off, and air nozzles 323 and 324 are on, directing film 201 toward spindle 338. Nozzles 322 and 325 are on, and nozzles 323 and 324 off, when the film is being directed toward spindle 338.

When a roll is completed, and the nozzles had been directing the trailing edge of the roll to one spindle, the nozzles are then controlled to direct the leading edge of the next roll of bags to the other spindle. Thus, the nozzles alternately direct the film to one of two paths. The change in paths, or alternations, occur after a plurality of bags—a roll—are wound. If the separator is in an intermittent mode, then nozzles perform an alternation after separating. In the every bag (overlap) mode they perform an alternation after a given count.

The preferred embodiment provides that the right and left spindles and associated components are mirror images of one another, although this is not required. Thus, spindle 338 winds counter-clockwise and spindle 337 winds clockwise.

The web, as it travels to spindles 337 and 338, is preferably held against conveyor belts 327 and 328 with a series of round elastic ropes. Also, one embodiment provides for static pinners 330 and 331 to hold the film against conveyor belts 327 and 328. Static pinners 330 and 331 can be bi-polar static pinners to not only hold the film against the conveyor, but to also cause the tail of the last bag of a roll to cling to the roll, by turning off the static neutralizer for the last few bags. Thus, the invention provides for statically pinning a tail of a last bag in a roll to the roll, to aid in manual handling of rolls, in automation handling of roll, and reduce the need to glue the tail of the last bag.

Conveyor belts 327 and 328 are preferably one wide belt or a series of narrower belts with a 1" gap there between. The gap allows for pop-up finger 340, 341 (one or more in various alternatives) to help direct the leading edge of the first bag into an air horn 342, 343, and around the winding spindle. Pop up fingers 340 and 341 intennittently direct the film near the spindle and retract after the first bag is transferred. The gap between belts also allows hot melt tail gluing to be used with less chance of glue getting on a conveyor belt.

Conveyor belt 328 is preferably mounted such that it pivots at an end closest the infeed nip, and away from fixed position spindle 338, as shown by the dashed lines and arrow 345, as the film roll grows in diameter. A like pivot is used for conveyor 327.

Each winding station may have a paper bander 346, 347. Because one bander can be used while the opposite spindle is winding, two banders which each run 20 cpm allow the overall winder to cycle at 40 cpm. Also, because there are two winding stations, each cycling at 20 cpm, pneumatic devices may be used with an overall speed of 40 cpm.

The spindles preferably use a prior art CMD®-designed Teflon® sleeve or bead blasted/chromed design. Also, because the spindles are fixed position spindles, they can use a simple push-off device that does not need to pivot, and can scrape at substantially 360 degrees around the spindle circumference to remove film easier with less chance of binding. The fixed position also allows for simple air connections to the spindles.

Because there are two stations cycling at 20 cpm (counts per minute), the machine runs at 40 cpm, and more time is allowed for roll inspection, culling, and rejecting than for a single station 40 cpm machine.

Numerous modifications may be made to the present invention which still fall within the intended scope hereof. Thus, it should be apparent that there has been provided in accordance with the present invention a method and apparatus for making and winding bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or priviledge is claimed are defined as follows:

1. A winder for a bag machine comprising;

an infeed nip defined between two infeed rollers;

a first spindle, located along a first alternative film path, wherein after leaving the infeed nip a film can follow the first alternative film path nip to the first spindle to be wound about the first spindle;

a second spindle, located along a second alternative film path, wherein after leaving the infeed nip the film can follow the second alternative film path nip to the second spindle to be wound about the second spindle;

an over speed nip defined between two over speed rollers, located along a film path, wherein the film moves from the infeed nip to the over speed nip, and then to one of the first and second alternative film paths, wherein the over speed nip is operable in an intermittent mode and in an every bag mode; and an overlapper disposed to provide the film to the first and second alternative film paths;

wherein the overlapper includes a plurality of rods mounted to follow an orbit that intersects the film path in at least two locations.

2. The winder of claim 1, wherein the plurality is at least five, and the orbit is generally elliptical.

3. The winder of claim 1, wherein the overlapper includes a plurality of air nozzles.

4. A method of winding bags from a continuous film, comprising;

feeding the film into a winder; and alternately directing the film along a first alternative path to a first spindle and along a second alternative path to a second spindle, wherein the alternations occur after a plurality of bags are wound;

prior to alternately directing, separating each bag from its succeeding bag; and overlapping succeeding bags, wherein overlapping includes moving a plurality of rods in an orbit that intersects the film path in at least two locations.

5. The method of claim 4, wherein moving includes moving in a generally elliptical orbit.

6. A bag machine comprising;

an unwind section disposed to receive a roll of film;

a forming section, disposed to receive the film from the unwind section an infeed nip defined between two infeed rollers, wherein the film travels from the forming section to the infeed nip;

a first spindle, located along a first alternative film path, wherein after leaving the infeed nip the film can follow the first alternative film path nip to the first spindle to be wound about the first spindle;

a second spindle, located along a second alternative film path, wherein after leaving the infeed nip the film can follow the second alternative film path nip to the second spindle to be wound about the second spindle;

an over speed nip defined between two over speed rollers, located along a film path, wherein the film moves from the infeed nip to the over speed nip, and then to one of the first and second alternative film paths, and wherein the over speed nip is operable in an intermittent mode and an every baa mode; and an overlapper haying a plurality of rods mounted to follow a generally elliptical orbit that intersects the film path in at least two locations, and having a plurality of air nozzles, and disposed to provide the film to the first and second alternative paths.

* * * * *